US011808510B2

(12) United States Patent
Cho et al.

(10) Patent No.: US 11,808,510 B2
(45) Date of Patent: Nov. 7, 2023

(54) ICE MAKER AND REFRIGERATOR HAVING THE SAME

(71) Applicant: SAMSUNG ELECTRONICS CO., LTD., Suwon-si (KR)

(72) Inventors: Yeon Woo Cho, Suwon-si (KR); Jin Jeong, Suwon-si (KR); Kook Jeong Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 330 days.

(21) Appl. No.: 17/285,026

(22) PCT Filed: Nov. 7, 2019

(86) PCT No.: PCT/KR2019/015102
§ 371 (c)(1),
(2) Date: Apr. 13, 2021

(87) PCT Pub. No.: WO2020/111565
PCT Pub. Date: Jun. 4, 2020

(65) Prior Publication Data

US 2022/0003480 A1 Jan. 6, 2022

(30) Foreign Application Priority Data

Nov. 27, 2018 (KR) ..... 10-2018-0148480

(51) Int. Cl.
*F25C 5/185* (2018.01)
*F25C 5/20* (2018.01)

(52) U.S. Cl.
CPC ..... *F25C 5/185* (2013.01); *F25C 5/22* (2018.01); *F25C 2305/0221* (2021.08); *F25C 2400/04* (2013.01); *F25C 2400/10* (2013.01)

(58) Field of Classification Search
CPC .... F25C 1/185; F25C 5/22; F25C 2305/0221; F25C 240/04; F25C 2400/10; F25C 2400/14
See application file for complete search history.

(56) References Cited

U.S. PATENT DOCUMENTS

2010/0236273 A1* 9/2010 Kang ..... F25C 1/25 62/347
2017/0108258 A1* 4/2017 Jeong ..... F25C 5/22

FOREIGN PATENT DOCUMENTS

JP 5-246438 A 9/1993
JP 2005-291682 A 10/2005
(Continued)

OTHER PUBLICATIONS

International Search Report dated Mar. 10, 2020, in corresponding International Patent Application No. PCT/KR2019/015102.

*Primary Examiner* — Elizabeth J Martin
(74) *Attorney, Agent, or Firm* — STAAS & HALSEY LLP

(57) ABSTRACT

A refrigerator includes a main body in which a storage compartment is formed, a door to open and close the storage compartment, and an ice maker provided on the door to generate ice, wherein the ice maker includes a frame having a water container mounting part, an ice making tray provided on the frame and in which ice is generated, and a water container detachably mounted on the frame to supply water to the ice making tray, and wherein the water container is configured such that at least a portion of the water container is opened when mounted on the water container mounting part.

14 Claims, 16 Drawing Sheets

(56) References Cited

FOREIGN PATENT DOCUMENTS

| | | | |
|---|---|---|---|
| KR | 10-2012-0086634 | A | 8/2012 |
| KR | 10-2013-0059988 | A | 6/2013 |
| KR | 10-2013-0128563 | A | 11/2013 |
| KR | 10-1548263 | B1 | 8/2015 |
| KR | 10-2015-0100265 | A | 9/2015 |
| KR | 10-2017-0043735 | A | 4/2017 |

* cited by examiner

ICE MAKER AND REFRIGERATOR HAVING THE SAME

CROSS-REFERENCE TO RELATED APPLICATIONS

This application is a U.S. National Stage Application which claims the benefit under 35 U.S.C. § 371 of International Patent Application No. PCT/KR2019/015102 filed on Nov. 7, 2019, which claims foreign priority benefit under 35 U.S.C. § 119 of Korean Patent Application 10-2018-0148480 filed on Nov. 27, 2018, in the Korean Intellectual Property Office, the contents of both of which are incorporated herein by reference.

TECHNICAL FIELD

The present disclosure relates to an ice maker and a refrigerator having the same, and more particularly, to a refrigerator having a manual ice maker.

BACKGROUND ART

Generally, a refrigerator is an appliance that keeps food fresh by including a main body, a door, a storage compartment formed between the main body and the door to store the food, and a cold air supply system for supplying cold air to the storage compartment. The storage compartment includes a refrigerating chamber that is maintained at temperature of about 0 degrees Celsius to 5 degrees Celsius to keep food refrigerated, and a freezing chamber that is maintained at temperature of about 0 degrees Celsius to −30 degrees Celsius to keep food frozen.

A refrigerators may be equipped with an ice maker to make ice. The ice maker includes an ice making tray for generating ice by storing and cooling water, and an ice bucket for storing ice separated from the ice making tray.

Ice makers may be classified into an automatic ice maker in which a water supply process, an ice making process, an ice separation process, and an ice ejection process are automatically performed, and a manual ice maker in which the respective processes are manually performed.

The process of supplying water to the ice making tray of the manual ice maker includes processes in which the ice making tray is taken out from an ice making tray mounting part, water is poured into the ice making tray so that the water does not overflow, and the ice making tray in which water is stored is again mounted on the ice making tray mounting part. Therefore, it is not easy to supply a predetermined amount of water to the ice making tray, and during the water pouring process, water may overflow or splash around.

DISCLOSURE

Technical Problem

The present disclosure is directed to providing a refrigerator having an ice maker with an improved water supply structure.

The present disclosure is directed to providing a refrigerator having an ice maker capable of supplying a predetermined amount of water to an ice making tray.

The present disclosure is directed to providing a refrigerator having an ice maker capable of having a simple structure and improving reliability by improving the mounting structure of a water container.

Technical Solution

An aspect of the present disclosure provides a refrigerator including a main body in which a storage compartment is formed, a door to open and close the storage compartment, and an ice maker provided on the door to generate ice, wherein the ice maker includes a frame having a water container mounting part, an ice making tray provided on the frame and in which ice is generated, and a water container detachably mounted on the frame to supply water to the ice making tray, and wherein the water container is configured such that at least a portion of the water container is opened when mounted on the water container mounting part.

The water container may include a water container body with an open one side, and a water container cover movably provided on the water container body to open and close the opening, and the water container cover may be caught on the water container mounting part and retreated in a direction opposite to a direction in which the water container is mounted.

The water container cover may be configured to be supported by the water container mounting part to be moved from the water container body and open at least a portion of the water container body, when the water container is mounted.

The water container cover may include a locking part provided to be supported by the frame when the water container is mounted.

The refrigerator may further include a slide provided to move the water container cover and the water container body.

The slide may include a first slide part formed on the water container cover, and a second slide part formed on the water container body to correspond to the first slide part.

The first slide part may be formed on an edge of the water container cover.

The water container body may include a guide surface formed to be inclined to guide the stored water toward the opening.

The water container may be coupled to the frame in a horizontal direction, and the frame may include a guide configured to guide the movement of the water container.

The water container may be mounted such that a rear end of the water container is tilted downward by being guided by the guide.

The frame may include a water supply guide provided to correspond to the opening to guide water in the water container to the ice making tray.

The frame may include a water container support part provided such that the water container is supported to be inclined.

The water container cover may have a first position in a horizontal state, and a second position in a tilted state after being mounted on the water container mounting part.

The guide may include a first guide portion to guide the water container at the first position, and a second guide portion to guide the water container at the second position.

The water container cover may include a first part, a second part separated from the first part, and an elastic support part to connect and elastically support the first part and the second part, and the first part may be provided to be open and close with respect to the second part.

Another aspect of the present disclosure provides an ice maker including a frame having a water container mounting part, an ice making tray provided on the frame and in which ice is generated, and a water container detachably mounted on the frame to supply water to the ice making tray, wherein the water container includes a water container body with at least a portion having an opening, and a water container cover configured to be movable to open and close the opening, and wherein when the water container is mounted on the water container mounting part, the water container cover is caught on the water container mounting part and retreated in a direction opposite to a direction in which the water container is mounted to open at least a portion of the opening.

The water container cover may be configured to be supported by the water container mounting part to be moved from the water container body and open at least a portion of the water container body, when the water container is mounted.

The water container cover may include a locking part provided to be supported by the frame when the water container is mounted.

The refrigerator may further include a slide provided to move the water container cover and the water container body.

The water container may be coupled to the frame in a horizontal direction, and the frame may include a guide configured to guide the movement of the water container.

Advantageous Effects

According to an embodiment of the present disclosure, a water supply structure of an ice maker can be improved so that an exact amount of water can be exactly supplied to an ice making tray, thereby preventing excessive water supply.

Further, by improving the mounting structure of a water container, the structure of the ice maker can be simplified and reliability can be improved.

Further, by applying a slide-type lid to the water container, the sealed state of the water container can be maintained when moved, thereby preventing dripping water.

Further, by mounting the water container in a horizontal direction, water supply can be stably performed.

MODE OF THE DISCLOSURE

Figure 1:
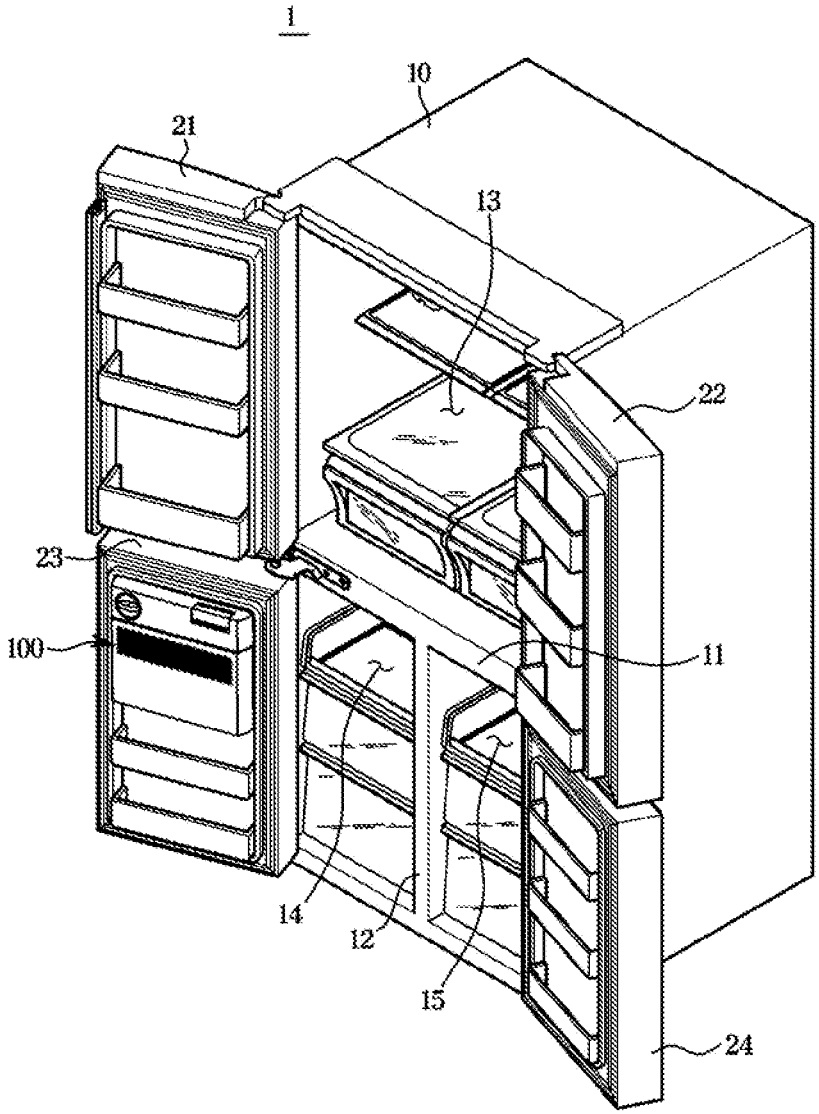
FIG. 1 is a view illustrating a refrigerator equipped with an ice maker according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
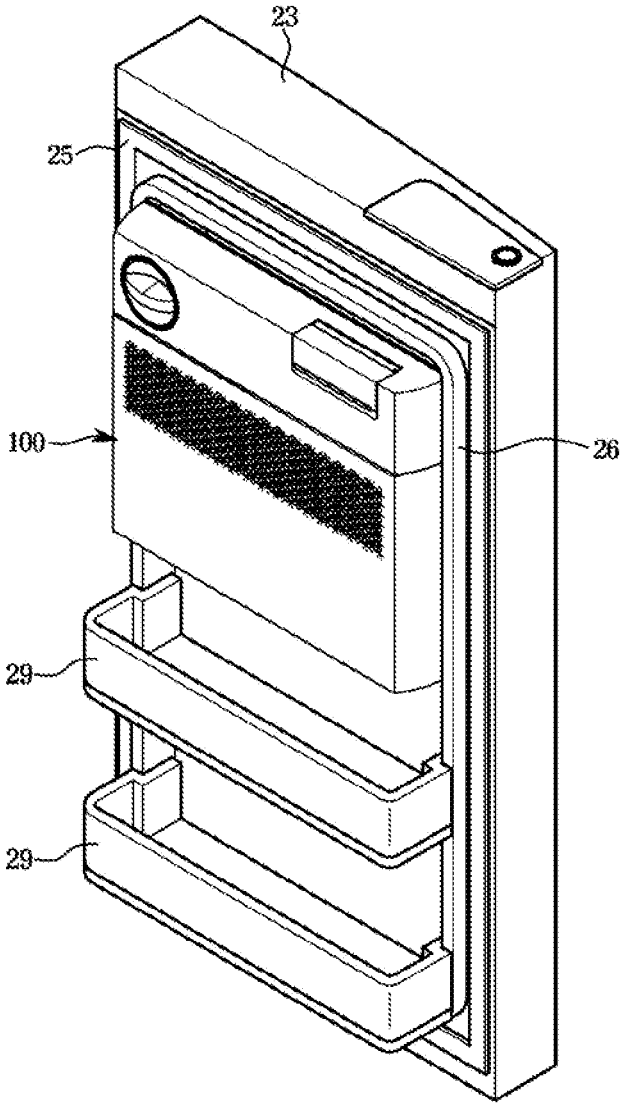
FIG. 2 is a perspective view of a refrigerator door on which the ice maker according to an embodiment of the present disclosure is mounted.
Figure 3:
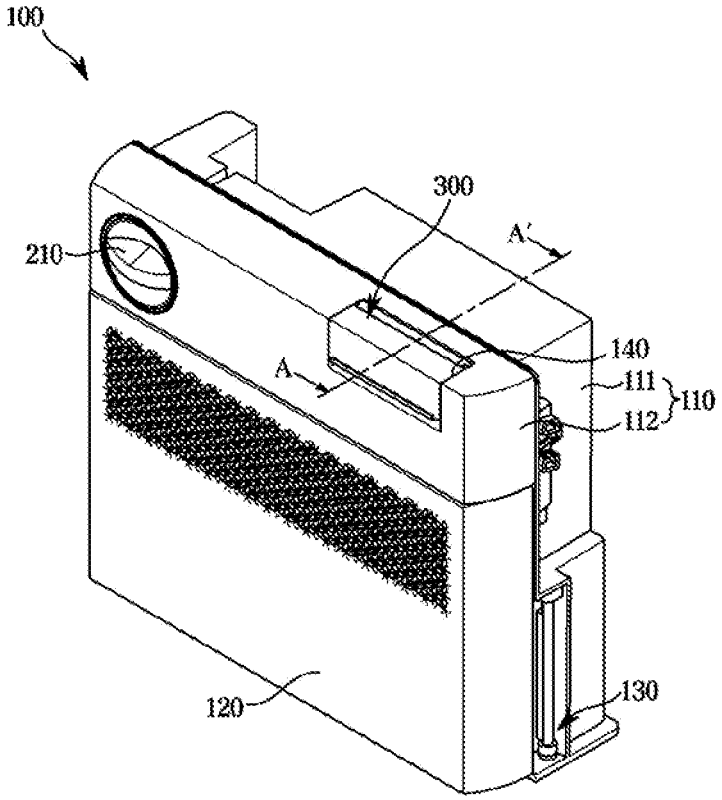
FIG. 3 is a perspective view of the ice maker according to an embodiment of the present disclosure.
Figure 4:
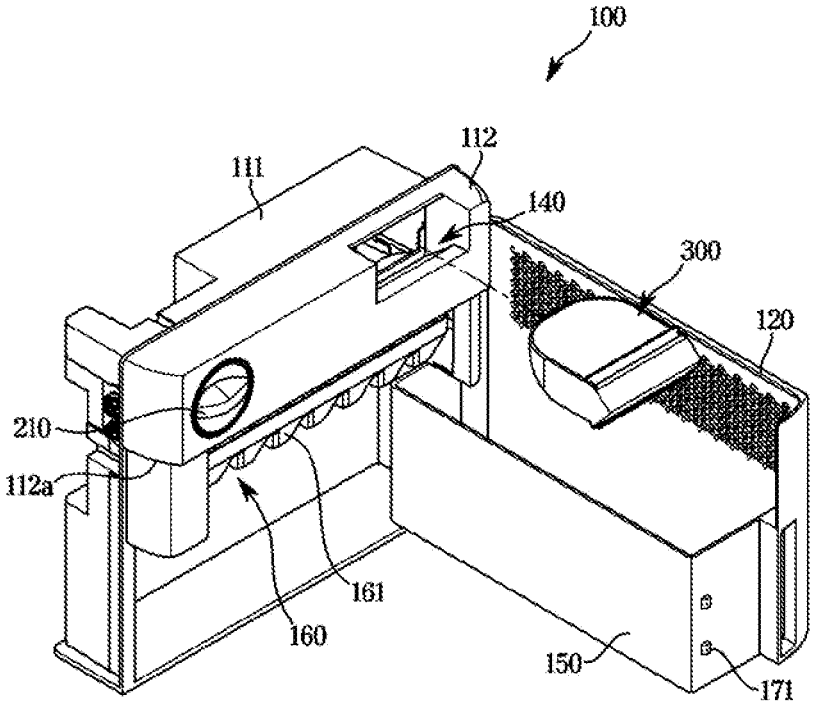
FIG. 4 is a partial exploded view of the ice maker according to an embodiment of the present disclosure.

FIG. 1 is a view illustrating a refrigerator equipped with an ice maker according to an embodiment of the present disclosure, FIG. 2 is a perspective view of a refrigerator door on which the ice maker according to an embodiment of the present disclosure is mounted, FIG. 3 is a perspective view of the ice maker according to an embodiment of the present disclosure, and FIG. 4 is a partial exploded view of the ice maker according to an embodiment of the present disclosure.

As illustrated in FIGS. 1 to 4, a refrigerator 1 includes a main body 10, a door 23, storage compartments 13, 14, and 15 formed by the main body 10 and the door 23, and a cold air supply system (not shown) to supply cold air to the storage compartments 13, 14, and 15.

The main body 10 may be formed in a box shape with an open front, and the doors 21, 22, 23, and 14 open and close the open front of the main body 10. The storage compartments 13, 14, and 15 may be partitioned from each other by a horizontal partition wall 11 and a vertical partition wall 12. The upper storage compartment 13 may be used as a refrigerating compartment, and the lower storage compartments 14 and 15 may be used as a freezing compartment.

The upper storage compartment 13 may be opened and closed by the doors 21 and 22, and the lower left storage compartment 14 and the lower right storage compartment 15 may be opened and closed by the door 23 and the door 24, respectively. The doors 21, 22, 23, and 24 may be rotatably coupled to the body 10.

The present embodiment illustrates a BMF type refrigerator (bottom mounted freezer type) having four doors, but the present disclosure is not limited thereto, and the present disclosure may be applied to various types of refrigerators, such as a top mounted freezer type (TMF type) refrigerator, a side by side type refrigerator, a french door type refrigerator, and a one-door type refrigerator.

The cold air supply system is composed of a compressor, a condenser, an expansion valve, an evaporator, and a blowing fan, and may generate cold air through a cooling cycle and supply the cold air to the storage compartments.

An ice maker 100 to generate ice may be mounted on a rear surface of the door 23. The ice maker 100 may be detachable from the rear surface of the door 23. The ice maker 100 is mounted on the rear surface of the door 23 to freeze water with cold air in the storage compartment 14 to generate ice.

Alternatively, the ice maker 100 may receive cooling energy directly from a refrigerant pipe (not shown) through which a refrigerant flows to generate ice by direct cooling.

A gasket 26 may be installed on the rear surface of the door 23 to soften an impact caused by a collision with the main body 10 when the door 23 is closed and to seal a gap between the door 23 and the main body 10. The gasket 26 may be installed along an edge of the rear surface of the door 23.

A door guard 29 may be mounted on the rear surface of the door 23.

The ice maker 100 may include a frame 110, an ice making tray 160 mounted on the frame 110 and in which ice is made, and an ice bucket 150 to store ice generated in the ice making tray 160.

The frame 110 may include a first frame 111 and a second frame 112 provided in the front of the first frame 111. The first frame 111 and the second frame 112 may be combined to form a space in which the ice making tray 160 and the ice bucket 150 are installed.

The ice making tray 160 may be disposed on the first frame 111. A water container mounting part 140 is provided on the second frame 112 such that a water container 300 to store water to be supplied to the ice making tray 160 is installed therein. The water container mounting part 140 may be formed on one side of a front surface of the second frame 112. An ice separation lever 210 may be rotatably provided on the other side of the front surface of the second frame 112 so that ice may be separated from the ice making tray 160.

A cover 120 may be installed on the second frame 112. A cover installation part 112*a* to install the cover 120 may be formed at a lower portion of the front surface of the second frame 112. The cover 120 may be coupled to the second frame 112 by a hinge device 130.

The hinge device 130 may include a hinge shaft 131 provided on one side of the cover 120 and a hinge groove 132 provided in the first frame 111 to correspond to the hinge shaft 131. The cover 120 may be rotated forward of the frame 110 by the hinge device 130.

The ice bucket 150 may be provided on an inner surface of the cover 120. The cover 120 may be moved by being rotated forward of the frame 110. The ice bucket 150 provided on the cover 120 may be rotated and moved in a horizontal position. Accordingly, as the cover 120 is rotated forward without tilting, ice stored in the ice bucket 150 may be poured out or may not flow out.

Figure 5:
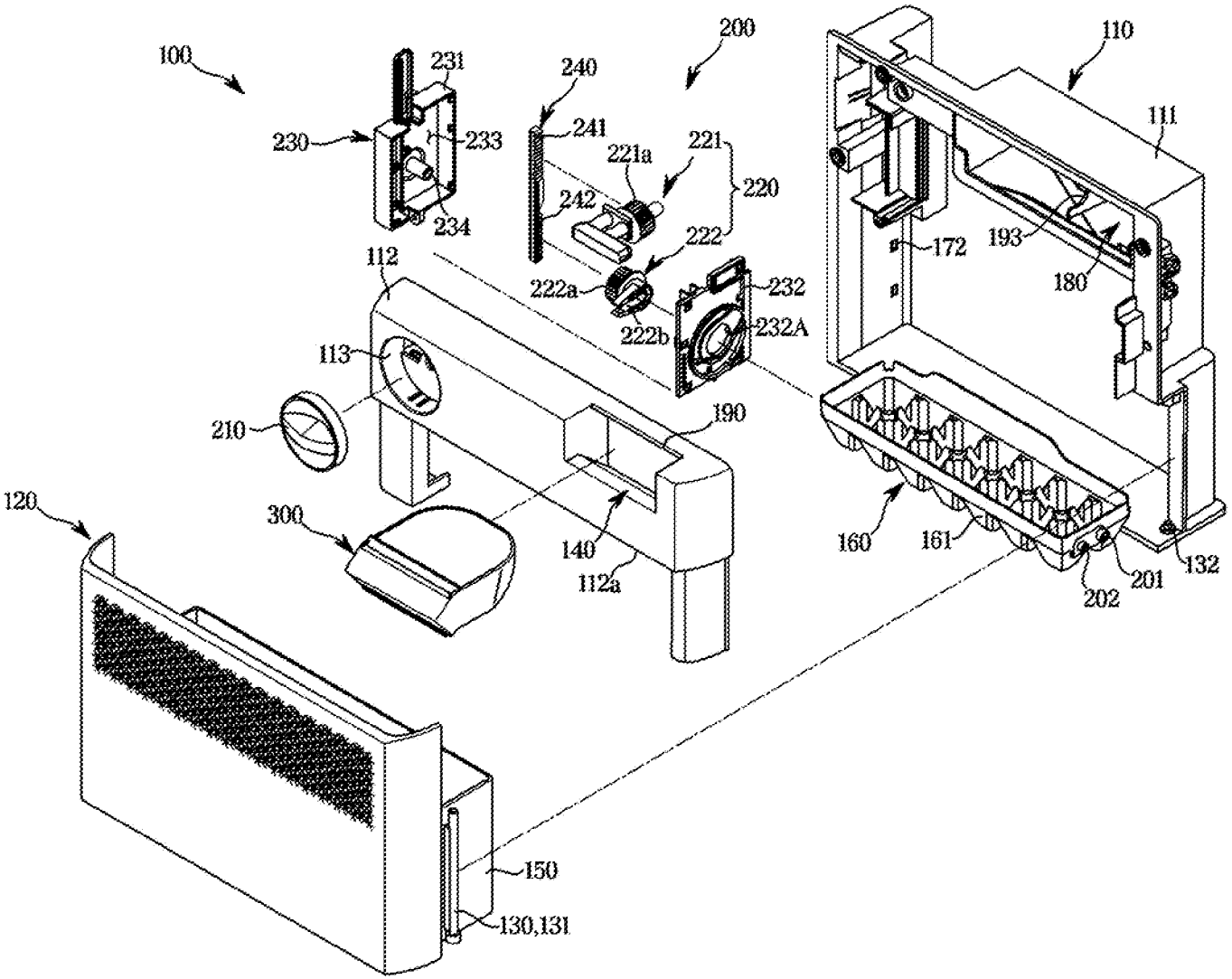
FIG. 5 is an exploded perspective view of the ice maker according to an embodiment of the present disclosure.
Figure 6:
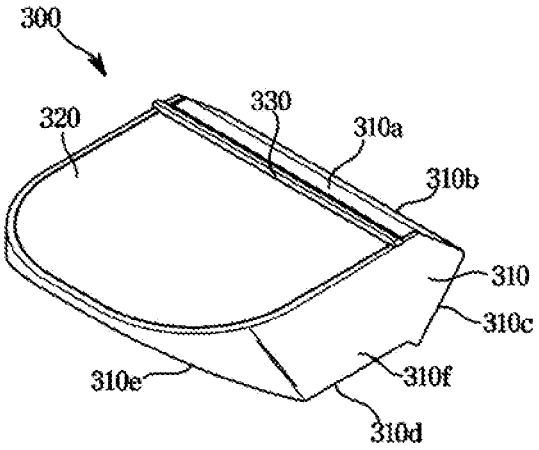
FIG. 6 is a perspective view of a water container of the ice maker according to an embodiment of the present disclosure.
Figure 7:
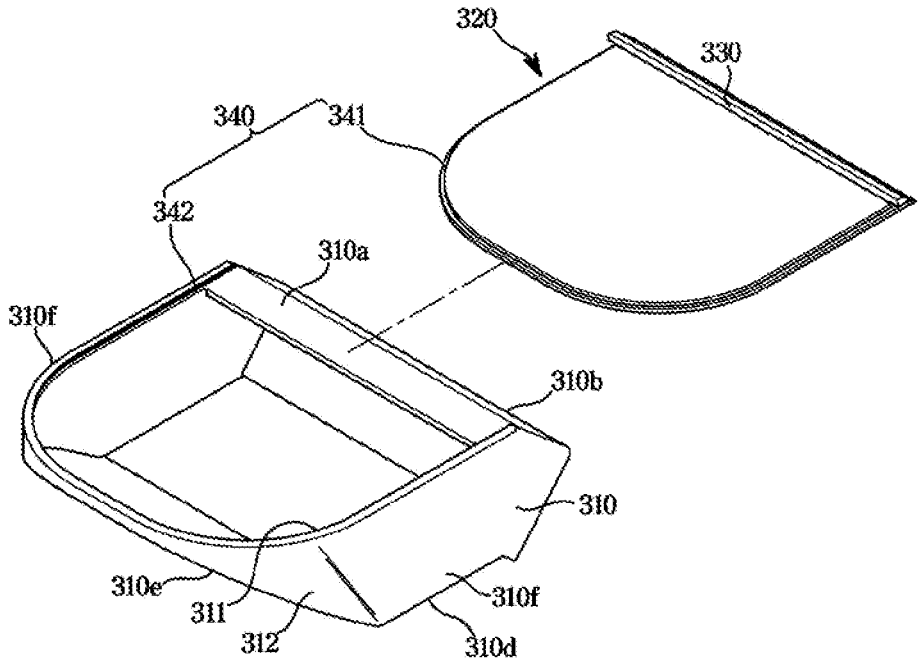
FIG. 7 is an exploded perspective view of the water container of the ice maker according to an embodiment of the present disclosure.
Figure 8:
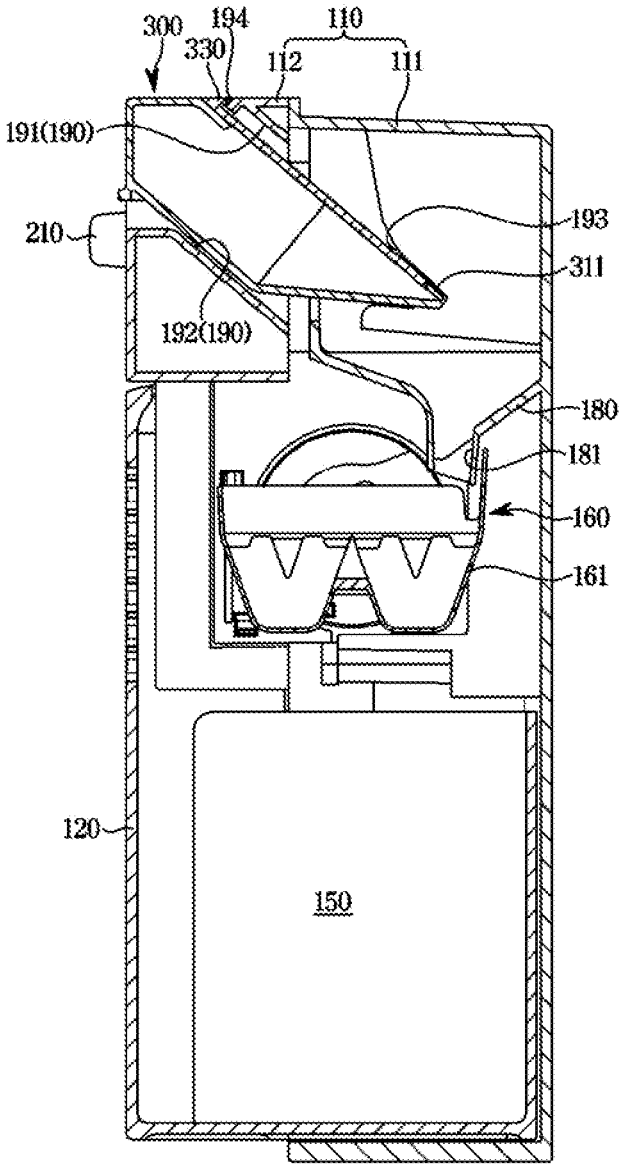
FIG. 8 is a cross-sectional view taken along line A-A' in FIG. 3, which illustrates a water supply flow path of the ice maker according to an embodiment of the present disclosure.

FIG. 5 is an exploded perspective view of the ice maker according to an embodiment of the present disclosure, FIG. 6 is a perspective view of a water container of the ice maker according to an embodiment of the present disclosure, FIG. 7 is an exploded perspective view of the water container of the ice maker according to an embodiment of the present disclosure, and FIG. 8 is a cross-sectional view taken along line A-A' in FIG. 3, which illustrates a water supply flow path of the ice maker according to an embodiment of the present disclosure.

As illustrated in FIGS. 5 to 8, the ice maker 100 may include the ice making tray 160 in which water is stored and ice is generated by cooling the stored water, the water container 300 to store water to be supplied to the ice making tray 160, the frame 110 on which the ice making tray 160 and the water container 300 are installed, and the ice bucket 150 to store ice separated from the ice making tray 160.

The present embodiment illustrates that one of the ice making tray 160 is disposed, but the present disclosure is not limited thereto. For example, a plurality of ice making trays may be disposed.

The ice making tray 160 includes a plurality of ice making cells 161 storing water. The ice making tray 160 may be rotatably provided such that the generated ice may be separated from the ice making tray 160. The ice making tray 160 may be rotated by a driving device 200.

The ice making tray 160 may include a rotation shaft 201. The rotation shaft 201 may protrude in a longitudinal direction of the ice making tray 160. The rotation shaft 201 may be provided such that the ice making tray 160 is rotatable. The rotation shaft 201 may be rotatably inserted into a rotation shaft receiving groove (not shown) provided on the frame 110.

The ice making tray 160 may include a connection pin 202 connected to a connection member 220. The connection pin 202 may be disposed to be spaced apart from the rotation shaft 201 by a predetermined distance. When a rotational force is applied to the connection pin 202 by the connection member 220, the ice making tray 160 may rotate about the rotation shaft 201.

The driving device 200 may include an ice separation lever 210 capable of rotating the ice making tray 160 to separate ice generated in the ice making tray 160. The ice separation lever 210 may be rotatably installed on a lever installation part 113 formed in the front of the second frame 112. The ice separation lever 210 may be rotatably formed in a circular shape. The lever installation part 113 may be formed in a circular shape to correspond to the ice separation lever 210.

The driving device 200 includes the ice separation lever 210 to rotate the ice making tray 160, and the connection member 220 to connect the ice separation lever 210 and the ice making tray 160. The connection member 220 of the driving device 200 may be installed in a driving case 230. A rack member 240 to rotate the connection member 220 and the connection member 220 in different directions may be installed in the driving case 230. The driving case 230 may include a first case 231 provided to be installed on the second frame 112, and a second case 232 coupled to the first case 231 and provided such that the ice making tray 160 may be rotatably connected thereto.

The ice making tray 160 may be connected to the ice separation lever 210 through a connection member 220. The connection member 220 may be provided inside the driving case 230.

The connection member 220 includes a first connector 221 and a second connector 222. The first connector 221 may be provided with a lever connection part 221*b* to be connected to the ice separation lever 210. The lever connection part 221*b* may be formed in the front of the first connector 221. A first gear 221*a* may be provided in the rear of the first connector 221. The second connector 222 may be connected to the rotation shaft 201 and the connection pin 202 of the ice making tray 160. The second connector 222 may include a connection frame 222*b* provided in the front to rotatably connect the ice making tray 160, and a second gear 222*a* provided in the rear.

The first gear 221*a* and the second gear 222*a* provided on the first connector 221 and the second connector 222, respectively, are provided to be engaged with a first rack 241 and a second rack 242 of the rack member 240, respectively. The first gear 221*a* of the first connector 221 is engaged with the first rack 241. The second gear 222*a* of the second connector 222 is engaged with the second rack 242. The rack member 240 may be formed to extend long in a vertical direction of the frame 110. The rack member 240 may be formed in a bar shape. The first rack 241 of the rack member 240 is formed on a surface facing the ice making tray 160 to have a predetermined length in the vertical direction. The second rack 242 of the rack member 240 is formed on a surface facing the rear of the frame 110 to have a predetermined length in the vertical direction. The rack member 240 is provided in the driving case 230 to be movable in the vertical direction. A connection member installation part 233 is provided in the drive case 230. The connection member installation part 233 may be provided with a second connector installation part 234 to rotatably install the second connector 222. The second connector installation part 234 is provided such that the second connector 222 is rotatable.

When the ice separation lever 210 rotates, the first gear 221*a* of the first connector 221 connected to the ice separation lever 210 rotates, and the rack member 240 may be moved by the first rack 241 engaged with the first gear 221*a*. When the rack member 240 moves, the second gear 222*a* engaged with the second rack 242 rotates, and the ice making tray 160 fixed to the connection frame 110 of the second connector 222 is rotated.

As the ice making tray 160 rotates, ice accommodated in the ice making cells 161 of the ice making tray 160 is transferred to the ice bucket 150.

Reference numeral 232*a*, which is not described, is a passing hole formed on the second case 232, and the passing hole is formed to connect the second connector 222 and the ice making tray 160.

The water container 300 is provided such that a predetermined amount of water may be exactly supplied to the ice making tray 160. The water container 300 is provided to exactly store the predetermined amount of water to be supplied to the ice making tray 160. The water container 300 may be mounted on the water container mounting part 140 of the frame 110 in a state where water is stored. The water container 300 may be provided with a scale indicating an amount to contain water.

The water container 300 may be mounted by being inserted in a horizontal direction into the water container mounting part 140 formed on the frame 110.

The water container 300 may include a water container body 310 with an opening 311 on one side, and a water container cover 320 to open and close the opening 311 of the water container body 310.

The water container 300 may have a cup shape with an open upper side. The water container 300 may have a hexahedral shape with at least one side open. The open one side of the water container 300 may be opened and closed by the water container cover 320 formed in a plate shape.

The water container body 310 may include an upper surface on which the opening 311 is formed (hereinafter, first surface 310*a*), a second surface 310*b* and a third surface 310*c* extending from the first surface 310*a* and forming a front surface of the water container 300, a fourth surface 310*d* extending from the third surface 310*c* and forming a bottom surface of the water container 300, a fifth surface 310*e* extending from the fourth surface 310*d* and forming a rear surface of the water container 300, and sixth surfaces 310*f* forming opposite side surfaces of the water container 300. The fifth surface 310*e* forming the rear surface of the water container body 310 may include a guide surface 312 formed to be inclined to guide the stored water toward the opening 311. The water container body 310 may form a storage space in which water may be stored. Water may flow out through the opening 311 of the first surface 310*a* of the water container 300.

That is, when the water container 300 is at a position (first position) in which the first surface 310*a* is disposed in a horizontal state toward an upper side, water may be stored in the water container 300, and when the water container 300 is at a position (second position) in which the first surface 310*a* of the water container 300 is disposed in an inclined state, which is in a state of being inserted into the water container mounting part 140, water in the water container 300 may flow out.

An embodiment of the present disclosure illustrates that the guide surface of the water container body having an inclination is the fifth surface, but the present disclosure is not limited thereto. For example, the guide surface may be the other surface of the water container body.

The water container cover 320 is movably installed on the first surface 310*a* of the water container body 310 to open and close the opening 311.

The water container cover 320 may be formed in a shape corresponding to the first surface 310*a* of the water container body 310. The water container cover 320 may be formed in a plate shape. The water container cover 320 may include a locking part 330 protruding such that at least a portion of the water container cover 320 may be caught on the frame 110 when the water container 300 is mounted on the water container mounting part 140 of the frame 110. The locking part 330 may be formed at an end of one side of the water container cover 320. The locking part 330 may be disposed at a front end of the water container cover 320. The locking part 330 may be formed to be caught on the frame 110. The locking part 330 may be formed to be caught on the water container mounting part 140 of the frame 110.

The water container mounting part 140 of the frame 110 may be provided with a locking protrusion 194 on which the locking part 330 of the water container cover 320 is caught. The locking part 330 of the water container cover 320 is caught on and supported by the locking protrusion 194 so as not to be no longer moved. The locking protrusion 194 may be formed on the frame 110. The locking protrusion 194 may be formed on the water container mounting part 140. The locking protrusion 194 may be provided at a front end of the water container mounting part 140.

The water container body 310 and the water container cover 320 are coupled by the slide 340. The water container cover 320 may be moved from the water container body 310 through the slide 340.

The slide 340 may include a first slide part 341 formed on the water container cover 320 and a second slide part 342 formed on the water container body 310. The first slide part 341 may be formed on an outer edge of the water container cover 320. The second slide part 342 may be formed to correspond to the first slide part 341. The second slide part 342 may be formed on the first surface 310*a* of the water container body 310. The first slide part 341 may include a protrusion formed to protrude. The second slide part 342 may include a rail having a shape corresponding to the first slide part 341. The second slide part 342 of the water container body 310 and the first slide part 341 of the water container cover 320 are provided to move by being engaged with each other. An embodiment of the present disclosure illustrates that the first slide part and the second slide part are a protrusion and a groove, but the slide part may include various configurations that allow the water container cover to be moved from the water container body.

The water container 300 may be coupled to the water container mounting part 140 of the frame 110 in a state where the water container cover 320 is completely coupled to the water container body 310.

The water container mounting part 140 may include a guide 190 to guide the movement of the water container 300. The guide 190 may guide the water container 300, which is inserted in the horizontal direction to the water container mounting part 140, such that a rear end thereof is tilted downward. The guide 190 may be provided on the frame 110. The guide 190 may include a first guide portion 191 to guide the rear end of the water container 300, which is located in the horizontal direction, to be tilted, and a second guide portion 193 to support the rear end of the water container 300 guided to be tilted by the first guide portion 191.

The first guide portion 191 may be provided in the front of the water container mounting part 140 of the frame 110, and the second guide portion 193 may be provided in the rear of the water container mounting part 140 of the frame 110.

The first guide portion 191 may be provided on the second frame 112 to have an inclination of a predetermined length. The second guide portion 193 on the first frame 111 to have an inclination of a predetermined length.

The frame 110 may further include a support surface 192 to support the fourth surface 310*d* of the water container 300 in a state where the water container 300 is inserted into the water container mounting part 140. The support surface 192 may be provided on the water container mounting part 140 of the frame 110. The water container 300 may be stably supported by the first guide portion 191 and the support surface 192 in the state of being inserted into the water container mounting part 140. With this configuration, when the water container 300 is inserted into the water container mounting part 140 of the frame 110, the locking part 330 of the water container cover 320 is caught on and supported by the locking protrusion 194 of the water container mounting part 140. In a state where the water container cover 320 is supported by the frame 110, the water container body 310 is coupled to the water container mounting part 140.

The opening 311 of the water container body 310 is opened between the water container cover 320 and the water container body 310, and water stored in the water container 300 is discharged through the opening 311 opened.

In this case, the frame 110 may include a water supply guide 180 to guide water discharged through the opening 311 of the water container 300. The water supply guide 180 may be provided at a position corresponding to the opening 311 of the water container 300. The water supply guide 180 includes a water supply hole 181 disposed on the ice making tray 160. The water supply hole 181 of the water supply guide 180 is provided to guide water in the water container 300 to the ice making tray 160.

The opening 311 to discharge water in the water container 300, the water supply guide 180 to guide water discharged through the opening 311, the ice making tray 160 to receive water from the water supply guide 180, and the ice bucket 150 to which ice in the ice making tray 160 is transferred may be disposed on the same line in the vertical direction.

Figure 9:
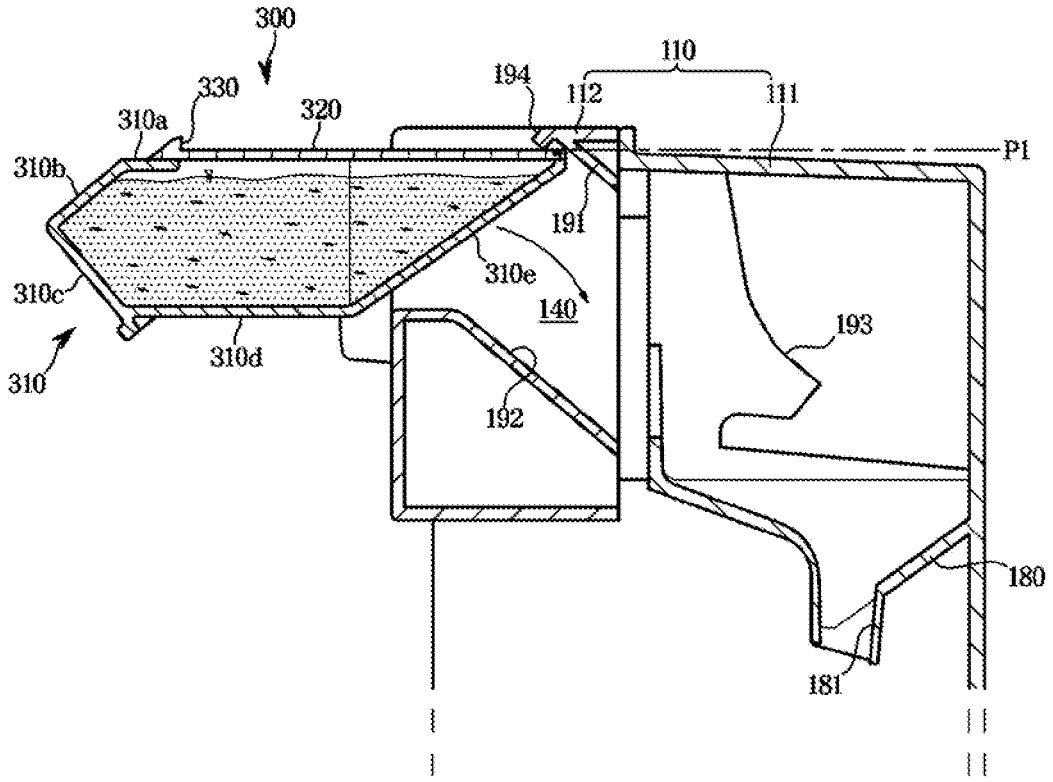
FIGS. 9 to 11 are views illustrating water supply states according to the installation of the water container of the ice maker according to an embodiment of the present disclosure.
Figure 10:
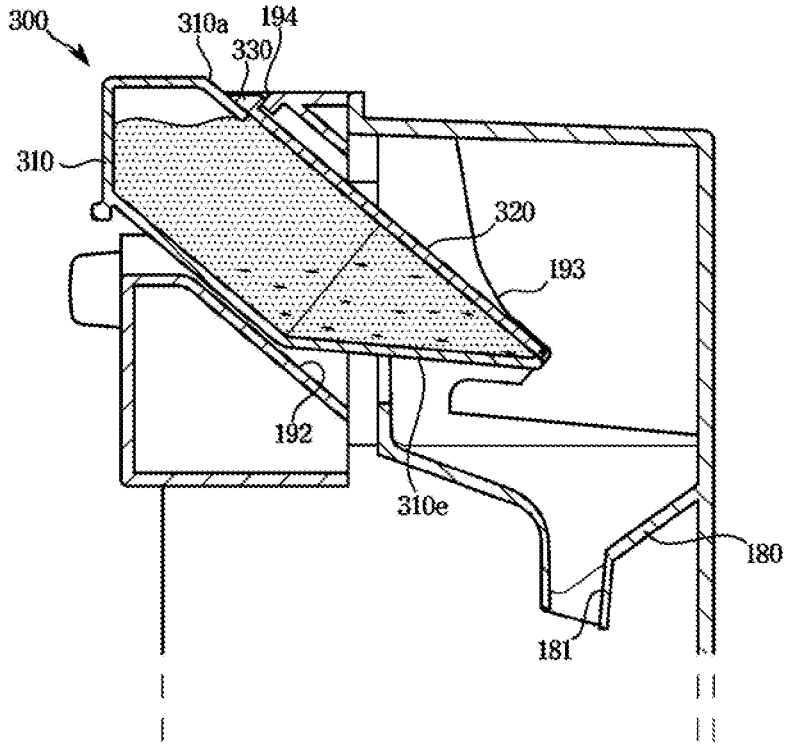
Figure 11:
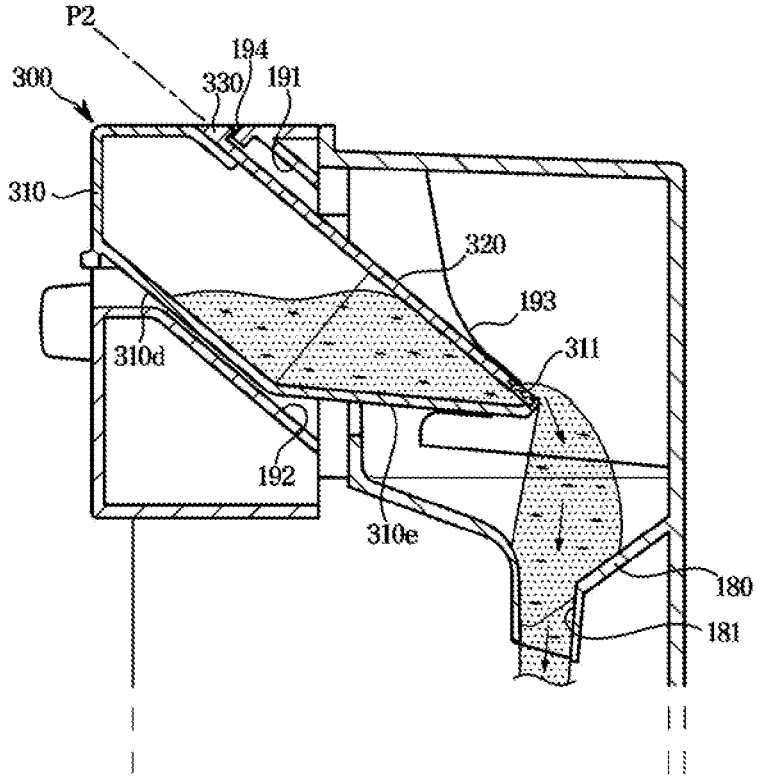

FIGS. 9 to 11 are views illustrating water supply states according to the installation of the water container of the ice maker according to an embodiment of the present disclosure.

The water container 300 may be moved in a state where water is stored in the water container 300 and the water container cover 320 is completely coupled to the water container body 310 to be sealed.

When the water container 300 is inserted into the water container mounting part 140 in the horizontal direction at the first position P1 in which the water container cover 320 is disposed in the horizontal direction on the frame 110, the water container 300 is guided by the first guide portion 191 of the water container mounting part 140 and is tilted at a predetermined angle.

The water container cover 320 is mounted on the water container mounting part 140 in a state of being tilted at the predetermined angle (second position). In this case, in the state where the water container cover 120 and the water container body 310 are completely coupled, water in the water container 300 does not leak to the outside.

When the water container body 310 is inserted into the water container mounting part 140, a portion of the water container 300 is supported by the second guide portion 193 and the support surface 192. When the locking part 330 of the water container cover 320 is caught on the locking protrusion 194 of the water container mounting part 140, the water container cover 320 is no longer moved.

When the water container body 310 is completely inserted into the water container mounting part 140, the opening 311 of the water container body 310 is opened by a gap between the water container body 310 which is moving and the water container cover 320 which is no longer moved.

In this case, the water container cover 320 may be supported by the first surface 310*a* of the water container body 310. Water in the water container 300 is discharged through the opening 311 of the water container body 310. Water discharged through the opening 311 of the water container 300 is guided by the water supply guide 180 to be transferred to the ice making tray 160 through the water supply hole 181.

The water supply guide 180 may be formed in a dish or concave funnel shape to stably collect water discharged from the opening 311 of the water container 300.

Water supplied to the ice making tray 160 is moved to each of the ice making cells 161. Water in the water container 300 is distributed to each of the ice making cells 161 in which the predetermined amount of water is accommodated and then frozen to make ice of an appropriate size.

Ice in the ice making tray 160 may be rotated by the ice separation lever 210 to be separated from the ice making tray 160 and then transferred to the ice bucket 150.

Figure 12:
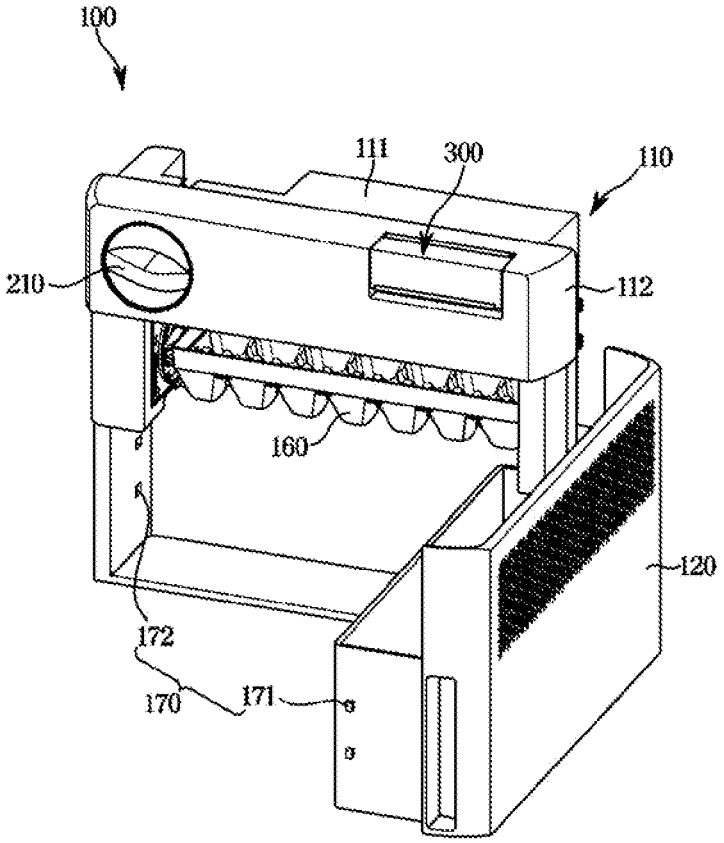
FIG. 12 is a perspective view illustrating a coupling part of a frame and a cover according to an embodiment of the present disclosure.

FIG. 12 is a perspective view illustrating a coupling part of a frame and a cover according to an embodiment of the present disclosure.

As illustrated in FIG. 12, a coupling part 170 to fix the cover 120 to the frame 110 may be provided on the cover 120 of the ice maker 100. The coupling part 170 may include a first coupling part 171 disposed on the cover 120 and a second coupling part 172 provided on the frame 110. The first coupling part 171 may include a protrusion formed to protrude from the ice bucket 150. The second coupling part 172 may be formed to correspond to the first coupling part 171. The second coupling part 172 may be disposed on the first frame 111. The second coupling part 172 may include a groove formed to be recessed on an inner surface of the first frame 111. An embodiment of the present disclosure illustrates that the coupling part includes a protrusion and a groove, but the present disclosure is not limited thereto. For example, the coupling part may be provided between the cover and the frame so that the cover may be easily fixed and separated to and from the frame.

Figure 13:
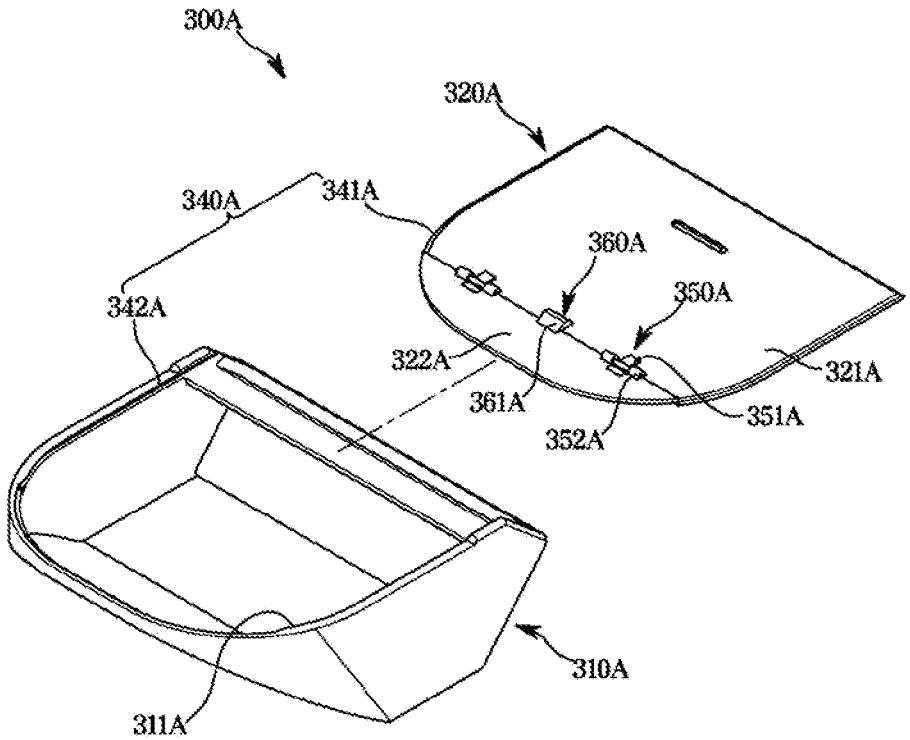
FIG. 13 is a perspective view of a water container of an ice maker according to another embodiment of the present disclosure.
Figure 14:
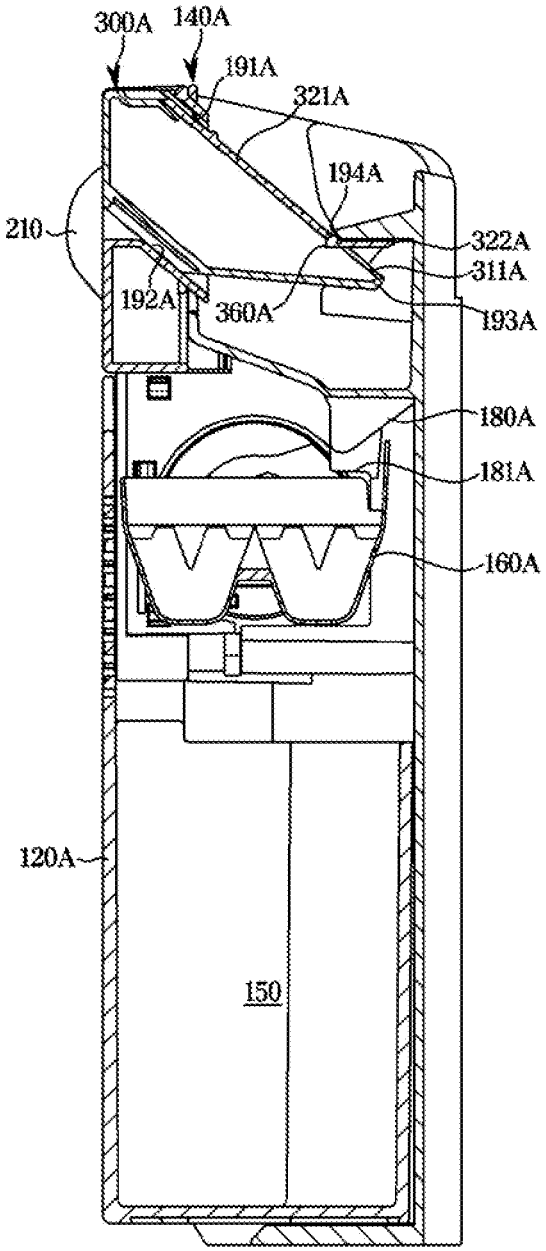
FIG. 14 is a view illustrating a water supply flow path of the ice maker according to another embodiment of the present disclosure.
Figure 15:
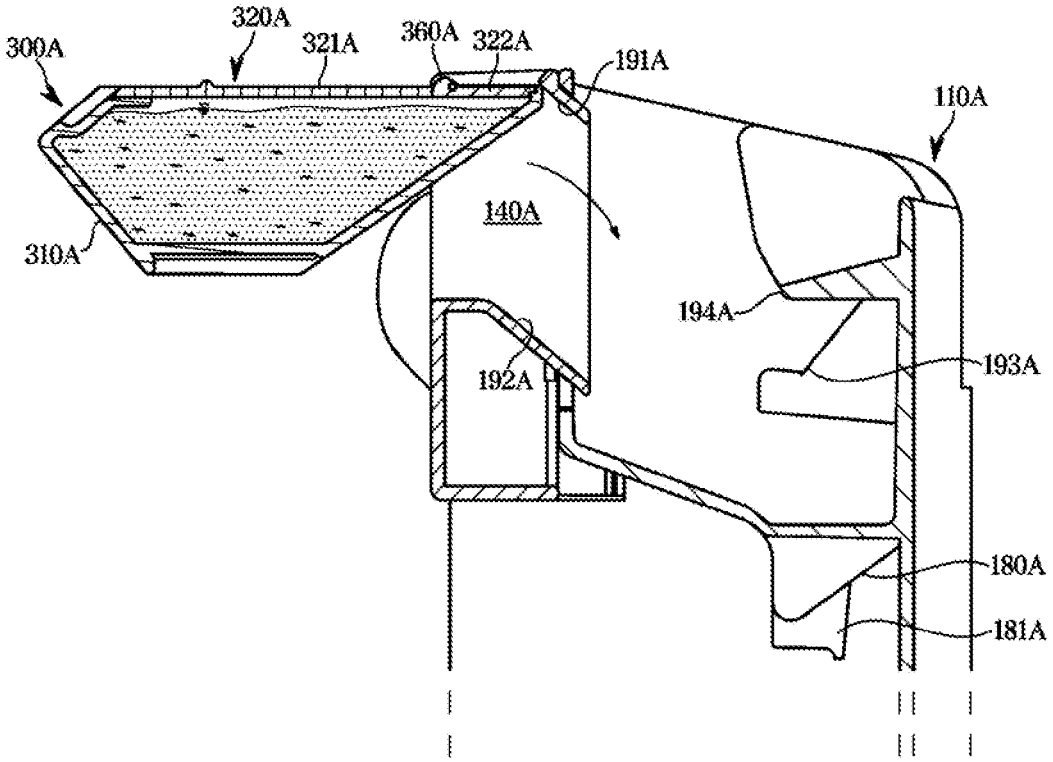
FIGS. 15 and 16 are views illustrating water supply states according to the installation of the water container of the ice maker according to another embodiment of the present disclosure.
Figure 16:
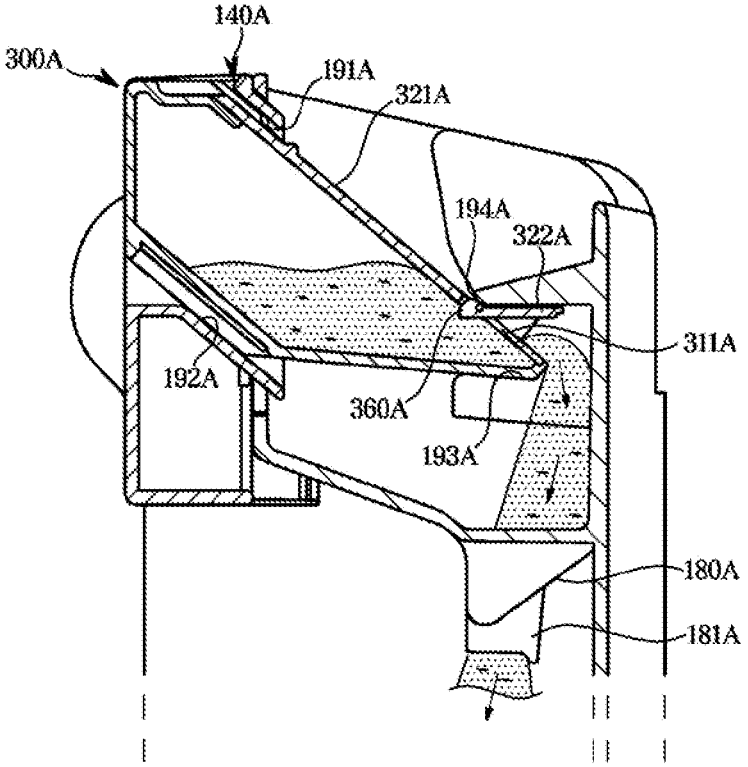

FIG. 13 is a perspective view of a water container of an ice maker according to another embodiment of the present disclosure, FIG. 14 is a view illustrating a water supply flow path of the ice maker according to another embodiment of the present disclosure, and FIGS. 15 and 16 are views illustrating water supply states according to the installation of the water container of the ice maker according to another embodiment of the present disclosure. Reference numerals which are not indicated refer to FIGS. 1 to 12.

As illustrated in FIGS. 13 to 16, a water container 300A of an ice maker 100A may include a water container body 310A with an opening 311A on one side, and a water container cover 320A provided to open and close the opening 311A of the water container body 310A.

The water container 300A may have a cup shape with an open upper surface. The water container body 310A may have a hexahedral shape with at least one open surface. The one open surface of the water container body 310A may be opened and closed by the water container cover 320A having a plate shape.

The water container body 310A may form a storage space in which water may be stored. Water may be stored or discharged through the opening 311A of the water container 310A.

The water container body 310A is provided with a water container cover 320A movably installed to open and close the opening 311A.

The water container cover 320A may be formed in a plate shape. The water container cover 320A may include a first part 321A, a second part 322A separated from the first part 321A, and an elastic supporter 350A provided to connect and elastically support the first part 321A and the second part 322A.

The elastic supporter 350A is provided such that the second part 322A is rotatable with respect to the first part 321A to open the opening 311A of the water container body 310A.

The elastic supporter 350A is provided to elastically support the first part 321A and the second part 322A. The elastic supporter 350A includes a leaf spring 351A to elastically support the first part 321A and the second part 322A, and a rotation support part 352A to support the leaf spring 351A. The rotation support part 352A connects the first part 321A and the second part 322A such that the second part 322A is rotatable with respect to the first part 321A on opposite sides of the leaf spring 351A. An embodiment of the present disclosure illustrates that two of the elastic supporters 350A are disposed, but the present disclosure is not limited thereto.

The water container cover 320A may include a locking part 360A protruding such that at least a portion of the water container cover 320A may be caught on a frame 110A when the water container 300A is mounted on the water container mounting part 140A of the frame 110A. The locking part 360A may be disposed on the second part 322A. The locking part 360A may be disposed at an end of the second part 322A. The locking part 360A may be formed at an upper end of the second part 322A. The locking part 360A may be formed to be caught on the frame 110A. The locking part 360A may be formed to be caught on the water container mounting part 140A of the frame 110A. A locking protrusion 144A on which the locking part 360A of the water container cover 320A is caught may be provided on the water container mounting part 140A of the frame 110A. The locking protrusion 144A supports such that the second part 322A may be rotated by pressing the locking part 360A of the water container cover 320A.

The water container body 310A and the water container cover 320A are coupled by a slide 340A. The water container cover 320A may move from the water container body 310A through the slide 340A.

The slide 340A may include a first slide part 341A formed on the water container cover 320A and a second slide part 342A formed on the water container body 310A. The first slide part 341A may be formed on an outer edge of the water container cover 320A. The first slide part 341A may be formed on the first part 321A and the second part 322A of the water container cover 320A, respectively. The second slide part 342A may be formed to correspond to the first slide part 341A. The first slide part 341A may include a protrusion formed to protrude. The second slide part 342A may include a rail having a shape corresponding to the first slide part 341A.

The water container 300A may be coupled to the water container mounting part 140A of the frame 110A in a state where the water container cover 320A is completely coupled to the water container body 310A.

The first part 321A and the second part 322A of the water container cover 320A may be maintained in a closed state by being elastically supported by the elastic supporter 350A.

The water container mounting part 140A may include a guide 190A to guide the movement of the water container 300A. The guide 190A may guide the water container 300A, which is inserted in the horizontal direction to the water container mounting part 140A, such that a rear end thereof is tilted downward. The guide 190A may be provided on the frame 110A. The guide 190A may include a first guide portion 191A to guide the rear end of the water container 300A, which is located in the horizontal direction, to be tilted, a second guide portion 192A to support the rear end of the water container 300A guided to be tilted by the first guide portion 191A, and a third guide portion 193A to support such that the water container 300A is stably mounted.

The first guide portion 191A may be provided in the front of the water container mounting part 140A of the frame 110A, and the third guide portion 193A may be provided in the rear of the water container mounting part 140A of the frame 110A.

With this configuration, when the water container 300A is inserted into the water container mounting part 140A of the frame 110A, the locking part 330A of the water container cover 320A is caught on and supported by the locking protrusion 194A. In a state where the locking part 360A of the second part 322A of the water container cover 320A is supported by the locking protrusion 194A of the frame 110, the water container body 310A is seated on the third guide portion 193A.

When the second part 322A of the water container cover 320A is pressed and rotated, the opening 311A of the water container body 310A is opened, and water stored in the water container 300A is discharged through the opening 311A opened.

In this case, the frame 110A may include a water supply guide 180A to guide water discharged through the opening 311A of the water container 300A. The water supply guide 180A may be provided at a position corresponding to the opening 311A of the water container 300A. The water supply guide 180A includes a water supply hole 181A disposed on the ice making tray 160A. The water supply hole 181A of the water supply guide 180A is provided to guide water in the water container 300A to the ice making tray 160A.

The opening 311A to discharge water in the water container 300A, the water supply guide 180A to guide water discharged through the opening 311A, the ice making tray 160A to receive water from the water supply guide 180A, and the ice bucket 150A to which ice in the ice making tray 160A is transferred may be disposed on the same line in the vertical direction.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

The invention claimed is:

1. A refrigerator comprising:
a main body in which a storage compartment is formed;
a door to open and close the storage compartment; and
an ice maker provided on the door to generate ice,
wherein the ice maker comprises:
a frame having a water container mounting part,
an ice making tray provided on the frame and in which ice is generatable, and
a water container detachably mounted on the frame to supply water to the ice making tray,
wherein the water container comprises a water container body including an opening, and a water container cover movably provided on the water container body to open and close the opening, and
wherein the water container cover is configured to be supported by the water container mounting part to be moved from the water container body and open at least a portion of the water container body, when the water container is mounted.

2. The refrigerator according to claim 1, wherein
the water container cover is capable of being caught on the water container mounting part and retreated in a direction opposite to a direction in which the water container is mounted.

3. The refrigerator according to claim 2, wherein
the water container cover comprises a locking part provided to be supported by the frame when the water container is mounted.

4. The refrigerator according to claim 2, further comprising:
a slide provided to move the water container cover and the water container body.

5. The refrigerator according to claim 4, wherein
the slide comprises a first slide part on the water container cover, and a second slide part on the water container body to correspond to the first slide part.

6. The refrigerator according to claim 5, wherein
the first slide part is on an edge of the water container cover.

7. The refrigerator according to claim 2, wherein
the water container body comprises a guide surface that is inclined to guide water stored in the water container body toward the opening.

8. The refrigerator according to claim 2, wherein
the frame comprises a water supply guide provided to correspond to the opening to guide water in the water container to the ice making tray.

9. The refrigerator according to claim 8, wherein
the frame comprises a water container support part provided such that the water container is capable of being supported to be inclined.

10. The refrigerator according to claim 2, wherein
the water container cover comprises a first part, a second part separated from the first part, and an elastic support part to connect and elastically support the first part and the second part, and
the first part is capable of being provided to be open and close with respect to the second part.

11. The refrigerator according to claim 1, wherein
the water container is coupled to the frame in a horizontal direction, and
the frame comprises a guide configured to guide movement of the water container.

12. The refrigerator according to claim 11, wherein
the water container is mounted such that a rear end of the water container is capable of being tilted downward by being guided by the guide.

13. The refrigerator according to claim 12, wherein
the water container cover has a first position in a horizontal state, and a second position in a tilted state after being mounted on the water container mounting part.

14. The refrigerator according to claim 13, wherein
the guide comprises a first guide portion to guide the water container at the first position, and a second guide portion to guide the water container at the second position.

* * * * *